United States Patent [19]

Schrewe et al.

[11] 4,086,957

[45] May 2, 1978

[54] WITHDRAWAL ROLL IN CONTINUOUS CASTING MACHINE

[75] Inventors: Hans Schrewe, Duisburg; Hans-Dieter Fünderich, Kettwig; Hans Butz, Duisburg, all of Germany

[73] Assignee: Mannesmann Aktiengesellschaft, Dusseldorf, Germany

[21] Appl. No.: 613,847

[22] Filed: Sep. 16, 1975

[30] Foreign Application Priority Data

Sep. 16, 1974 Germany ..... 2444614

[51] Int. Cl.[2] ..... F28F 5/02

[52] U.S. Cl. ..... 165/89; 29/110

[58] Field of Search ..... 165/87–89; 29/110, 123

[56] References Cited

U.S. PATENT DOCUMENTS

| | | | |
|---|---|---|---|
| 1,089,017 | 3/1914 | Smith | 29/123 |
| 1,200,226 | 10/1916 | Muttall | 165/89 |
| 2,531,988 | 11/1950 | Price | 165/89 |
| 2,867,414 | 1/1959 | Maloney, Jr. et al. | 165/89 |
| 2,875,985 | 3/1959 | Hold | 165/89 |

*Primary Examiner*—Charles J. Myhre
*Assistant Examiner*—Theophil W. Streule, Jr.
*Attorney, Agent, or Firm*—Ralf H. Siegemund

[57] ABSTRACT

The roll has an inner axial flow space extending into conical flow spaces with wider ends facing away from each other. Cooling water is fed to and discharged from central axial bores in the roll, there being radial distributor and collecting ducts leading from these central bores to the widest diameter portions of the conical flow spaces.

1 Claim, 1 Drawing Figure

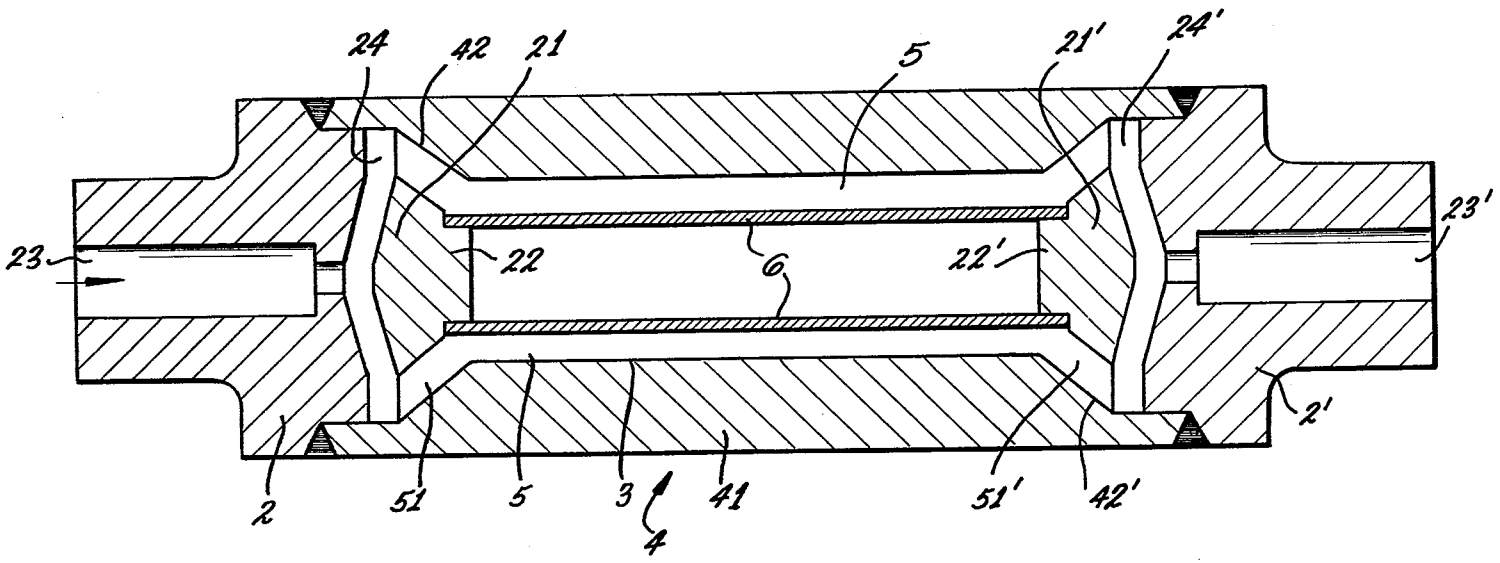
23'
2'
24'
21'
42'
51'
22'
5
6
41
4
3
5
21
22
42
51
24
2
23

WITHDRAWAL ROLL IN CONTINUOUS CASTING MACHINE

BACKGROUND OF THE INVENTION

The present invention relates to rolls for use as withdrawal rolls in continuous casting machines.

Rolls of this type engage an ingot as it is withdrawn from the casting machine, and the ingot is, of course, quite hot at that point. Thus, it is necessary to cool the rolls extensively. While external spray water cooling of the ingot will inherently cool also the rolls from the outside, internal cooling of the rolls is quite necessary to avoid too rapid a wear of them.

Water-cooled rolls as they are used are constructed to circulate water through internal ducts. It was found now that due to gravity aided by a considerable vapor pressure air pockets are produced in upper portions of the ducts or duct system. Bearing in mind that these rolls have horizontal axes, it will be observed that some rolls support an ingot as veered towards the horizontal, from below. Thus, such a roll may engage a hot ingot with surface portions underneath and inside of which happens to be such an air-pocket, causing insufficient cooling of that particular roll portion which actually needs cooling the most.

DESCRIPTION OF THE INVENTION

It is an object of the present invention to provide for a new and improved roll construction for continuous casting machines which rolls are adequately cooled.

In accordance with the preferred embodiment of the invention it is suggested that the roll is to have a central, cylindrical cooling space or gap, which extends axially into conical flow spaces, so that the axial outermost portions of the flow space have the largest distance from the roll axis. In furtherance of the invention, it is suggested to provide the roll journals with axially-central inlet and outlet ducts, from which extend radially outwardly extending distributing and collecting ducts which in turn communicate with the flow space portions of largest diameter.

It was found that the invention ensures adequate cooling of the roll, whereby particularly the central, cylindrical cooling space remains consistently filled with water. Any air inside of the cooling system gathers near the axial ends of the conical flow space portions. It was found particularly that such rolls when used as supporting lower rolls still have adequately cooled portions in engagement with the ingot; air pockets are not set up adjacent to those engaging roll portions.

DESCRIPTION OF THE DRAWING

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The one FIGURE is a cross-section through a roll constructed in accordance with the preferred embodiment.

Proceeding now to details of the description of the FIGURE, the roll depicted therein has a pair of journals 2 and 2', which are interconnected by a central tube 6, constituting the central or inner roll member. Thick flange portions of journals 2, 2' are provided to be welded to an outer or shell member 4 of the roll, whereby an annular or cylindrical gap 5 is set up between members 4 and 6.

The journal members 2, 2' each have an inner conical end portion 21, 21' respectively terminating in a cylindrical seat 22, 22', to which the ends of tube 6 are affixed, e.g. shrunken on, welded, or otherwise. The outer member 4 of the roll has a rather thick central portion 41, which defines a tubular interior 3 that receives tube 6 to define flow space 5. The axial ends of member 4 have large inner diameters for connection to cylindrical seats of the journal members 2, 2'.

The member 4 has inner transition zones 42, 42', of conical configuration facing radially respectively the cone portions 21, 21' of the journal member to establish therewith conically contoured flow spaces 51, 51' for water. These flow spaces 51, 51' could be plural obliquely oriented individual ducts together outlining a cone in each instance. These conical spaces or, better, frusto-conical spaces merge with their small diameter end with cylindrical gap 5, while the large diameter end of each cone faces away from the respective other one and establishes in each instance a zone of largest radial distance from the axis of the roll.

Journal members 2, 2' each are provided respectively with a central duct 23, 23' for connection to charge and discharge devices for cooling water. A distributor duct system having several radially extending ducts 24 and 24' communicate with the conical flow spaces 51, 51' to connect respectively inlet and outlet ducts 23, 23' thereto.

It can thus be seen that water is, for example, forced into the journal duct 23 and flows through the radial feeder or distributing ducts 24 into the conical flow space 51. and from there through gap 5. Thus, the water is fed to points of the flow space having largest radial distance from the roll axis. The discharge path is quite symmetrical and leads from gap 5 through the conical flow space 51' through collecting ducts 24' into the discharge duct 23'. In each position of the roll the interior of gap 5 is never the highest point of the flow space, but portions of the conical flow spaces extend always higher. Hence, in the case of trapped air, that air is not present in gap 5, but will collect in the upper portions of the horizontally-sideways disposed conical spaces 51, 51'. That trapped air, however, is still passed through by cooling water so that no coherent large scale air filled void in the cooling water is set up anywhere. The ingot engages the roll in the central region of member 4, i.e. along the outer periphery of central portion 41, which, therefore, is consistently filled throughout with cooling water.

The invention is not limited to the embodiments described above, but all changes and modifications thereof not constituting departures from the spirit and scope of the invention and intended to be included.

We claim:

1. Roll for continuous casting machines having an inner tubular core and an outer tubular member defining an axial gap as a central cylindrical flow space for cooling liquid, said outer member having an inner diameter at the central flow space and larger diameters near the axial ends of the outer member, the flow space being of conical configuration near the axial ends of the roll and having a larger diameter portion than the diameter of the central flow space accordingly, so that portions of the flow space closer to the axial ends of the roll have larger distance from the roll axis than the central flow space has, a pair of journal members being interconnected by a cylindrical element constituting said inner tube core, said outer tubular member having conically widened inner diameter portions near its axial ends defining said conical flow spaces together with conically contoured portions of said journal members, each journal member having a central duct from which extend internally radially extending ducts communicating with said conical flow spaces said inlet ducts for feeding coolant to and discharging the coolant from the portions of the flow spaces of largest diameter.

* * * * *